US009411309B1

(12) United States Patent
Kamano et al.

(10) Patent No.: US 9,411,309 B1
(45) Date of Patent: Aug. 9, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Tadao Kamano, Shizuoka (JP); Yoshifumi Hasebe, Shizuoka (JP); Takashi Ogiwara, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/729,240

(22) Filed: Jun. 3, 2015

(51) Int. Cl.
*G03G 21/20* (2006.01)

(52) U.S. Cl.
CPC ..... *G03G 21/206* (2013.01); *G03G 2221/1645* (2013.01)

(58) Field of Classification Search
CPC ..... G03G 21/206; G03G 2221/1645
See application file for complete search history.

(56) References Cited

U.S. PATENT DOCUMENTS 7,526,223 B2 * 4/2009 Adachi ..... G03G 15/2017 399/92
7,809,303 B2 * 10/2010 Igarashi ..... G03G 21/206 399/112
7,856,193 B2 * 12/2010 Kawamata ..... G03G 15/167 399/92
9,052,690 B2 * 6/2015 Udagawa ..... G03G 21/206

FOREIGN PATENT DOCUMENTS

JP 2003316237 A * 11/2003
JP 2004361626 A * 12/2004

* cited by examiner

*Primary Examiner* — Clayton E Laballe
*Assistant Examiner* — Leon W Rhodes, Jr.
(74) *Attorney, Agent, or Firm* — Amin, Turocy & Watson LLP; Gregory Turocy

(57) ABSTRACT

According to one embodiment, there is provided an image forming apparatus including a fan and a duct. The fan and the duct are provided in a housing. If the fan is driven, the duct guides the air flowing into the housing from an intake port of the housing toward components in the housing. The duct includes a bent section that changes a flowing direction of the air. The bent section includes holes.

9 Claims, 10 Drawing Sheets

IMAGE FORMING APPARATUS

FIELD

Embodiments described herein relate generally to an image forming apparatus.

BACKGROUND

There is known an image forming apparatus including a fan in a housing. In the image forming apparatus, when a fan is driven, the air on the outside flows into the housing.

The image forming apparatus is sometimes used in an environment with a lot of dust or dirt (hereinafter collectively referred to as "dust"). In this case, a lot of dust intrudes into the image forming apparatus together with the air.

In general, as measures against dust, it is known to provide a filter for dust collection. However, if the image forming apparatus is used in the environment with a lot of dust, an amount of dust accumulating in the filter increases. Therefore, it is likely that a frequency of replacement of the filter increases. Further, clogging sometimes occurs in the filter. If the clogging occurs in the filter, it is likely that a flow of the air in the housing is deteriorated.

DETAILED DESCRIPTION

Figure 1:
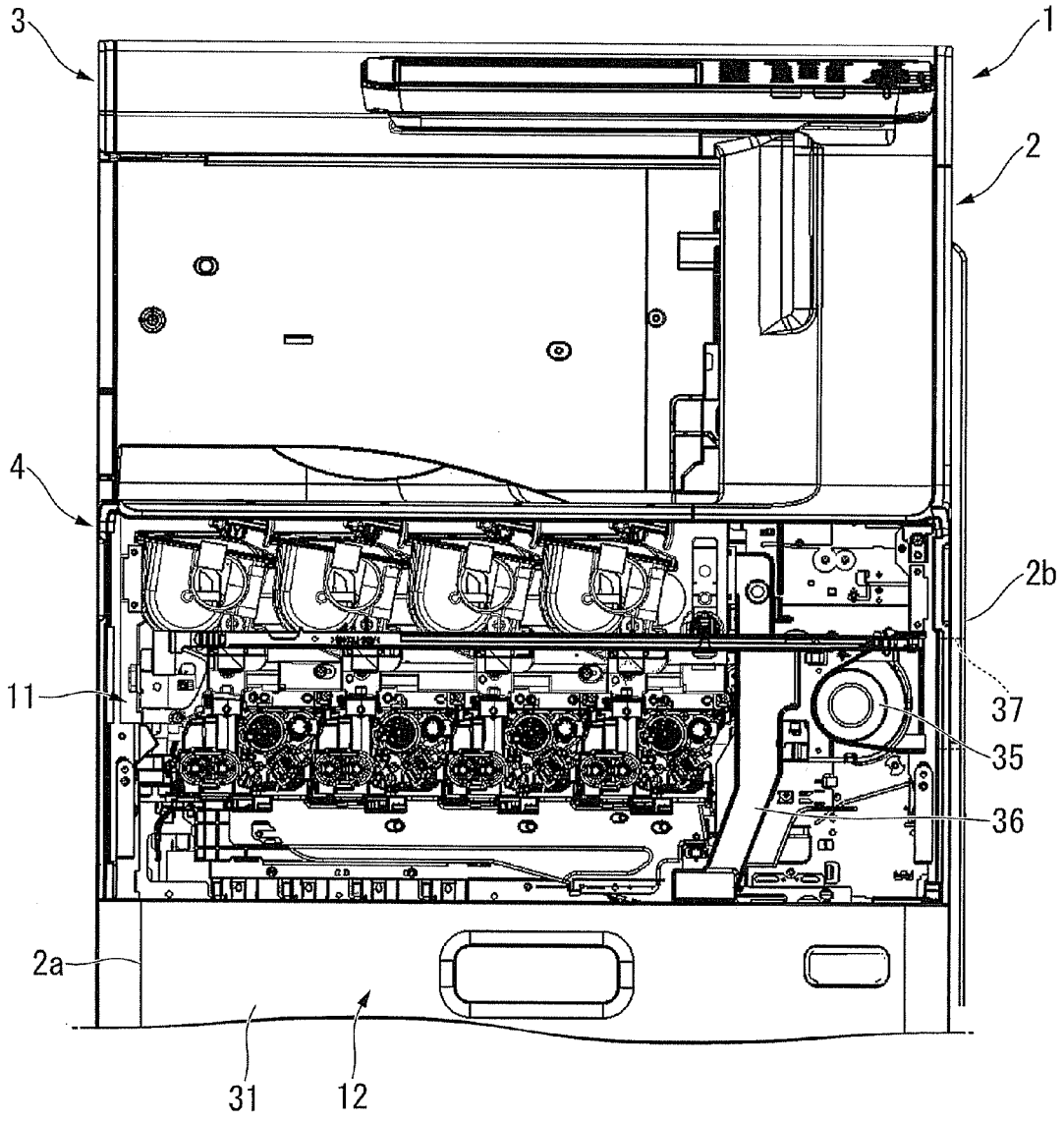
FIG. 1 is a front view showing an image forming apparatus in a first embodiment.

In general, according to one embodiment, there is provided an image forming apparatus including a fan and a duct. The fan and the duct are provided in a housing. If the fan is driven, the duct guides the air flowing into the housing from an intake port of the housing toward components in the housing. The duct includes a bent section that changes a flowing direction of the air. The bent section includes holes.

Exemplary embodiments are explained below with reference to the drawings. Note that, in the following explanation, the same reference numerals and signs are attached to components having the same or similar functions. Explanation of the components is sometimes omitted.

Note that "above" in this application includes not only "right above" but also "obliquely above". That is, "the air flowing upward" includes not only "the air flowing directly upward" but also "the air flowing obliquely upward". Similarly, "below" includes not only "right below" but also "obliquely below". That is, "the air flowing downward" includes not only "the air flowing directly downward" but also "the air flowing obliquely downward".

First Embodiment

FIG. 1 shows an image forming apparatus 1 in a first embodiment. As shown in FIG. 1, the image forming apparatus is a multi function peripheral (MFP) of an electrophotographic system.

First, the overall configuration of the image forming apparatus 1 is explained.

Figure 2:
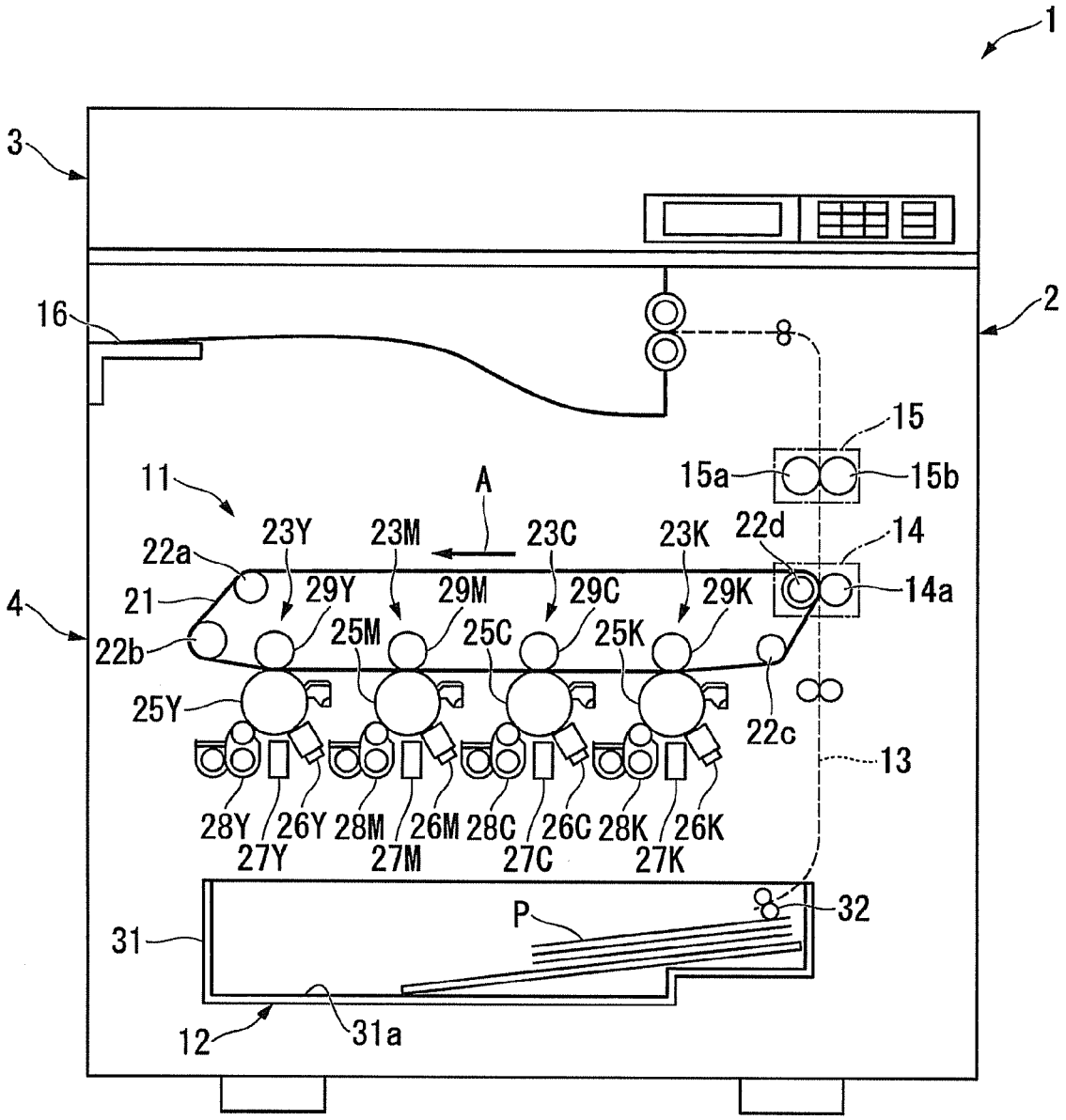
FIG. 2 is a diagram schematically showing a configuration example of the image forming apparatus in the first embodiment.

FIG. 2 schematically shows a configuration example of the image forming apparatus 1. As shown in FIG. 2, the image forming apparatus 1 includes a housing 2, a scanner unit 3, and a printer unit 4.

The housing (a machine body or a case) 2 forms an outer hull of the image forming apparatus 1. The housing 2 is formed in, for example, a box shape. The housing 2 houses the scanner unit 3 and the printer unit 4.

The scanner unit 3 reads image information of an original document as digital data.

The printer unit 4 forms an image on a sheet on the basis of image data. The image forming apparatus 1 forms an image using recording agents. The recording agents are, for example, toners.

The printer unit 4 is explained in detail.

As shown in FIG. 2, the printer unit 4 includes an intermediate transfer unit 11, a paper feeding unit 12, a conveying path 13, a secondary transfer unit 14, a fixing unit 15, and a paper discharge unit 16.

The intermediate transfer unit (a primary transfer unit) 11 includes an intermediate transfer belt 21, a plurality of rollers 22*a*, 22*b*, 22*c*, and 22*d*, and a plurality of image forming units 23Y, 23M, 23C, and 23K.

The intermediate transfer belt 21 is endlessly formed. The plurality of rollers 22*a*, 22*b*, 22*c*, and 22*d* support the intermediate transfer belt 21. Consequently, the intermediate transfer belt 21 is capable of endlessly traveling in a direction indicated by an arrow A in FIG. 2.

The plurality of image forming units (process units) 23Y, 23M, 23C, and 23K include a yellow image forming unit 23Y, a magenta image forming unit 23M, a cyan image forming unit 23C, and a black image forming unit 23K. The image forming units 23Y, 23M, 23C, and 23K respectively include photoconductive drums 25, charging units 26, exposing units 27, developing units 28, and transfer rollers 29. The configurations of the image forming units 23Y, 23M, 23C, and 23K are the same one another except that colors of recording agents are different. Therefore, in the figure, characters Y, M, C, and K respectively meaning yellow, magenta, cyan, and black are attached to signs of the components.

The charging units (electrifying chargers) 26 charge the surfaces of the photoconductive drums 25. The charging units 26 include discharge needles 26*a* and grids 26*b* (see FIG. 6). For example, the charging units 26 are charging units of a scorotron type. When charging the photoconductive drums 25, the charging units 26 emit ozone. Therefore, the air containing the ozone tends to be held up in the vicinities of the charging units 26.

The exposing units (exposing scanning heads) 27 expose the surfaces of the photoconductive drums 25 to light. Consequently, electrostatic latent images based on image data are formed on the surfaces of the photoconductive drums 25.

The developing units 28 are capable of storing the recording agents corresponding to the colors. The developing units 28 supply the recording agents to the surfaces of the photoconductive drums 25. Consequently, the recording agents adhere to latent image portions of the photoconductive drums 25.

A deficiency tends to occur if the temperature of the recording agents rises. Therefore, the developing units 28 are one of components that should be cooled among the components of the image forming apparatus 1.

The transfer rollers 29 face the intermediate transfer belt 21 from the opposite side of the photoconductive drums 25. Consequently, the recording agents are transferred (primarily transferred) from the surfaces of the photoconductive drums 25 to the intermediate transfer belt 21.

Figure 3:
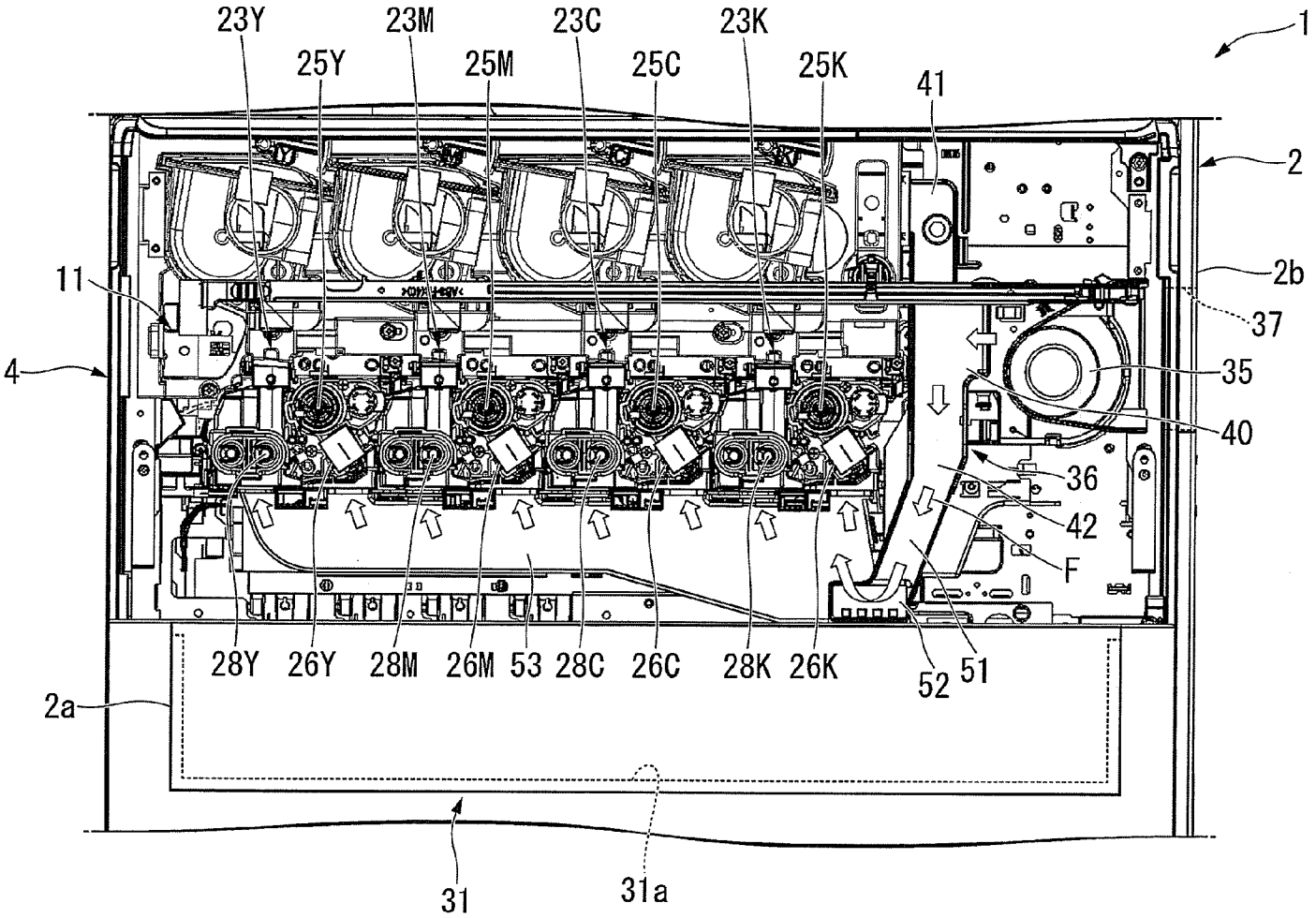
FIG. 3 is a front view showing an intermediate transfer unit, a fan, and a duct in the first embodiment.

FIG. 3 shows the intermediate transfer unit 11 of the image forming apparatus 1. As shown in FIG. 3, the four image forming units 23Y, 23M, 23C, and 23K are disposed side by side in the horizontal direction. In the image forming units 23Y, 23M, 23C, and 23K, the charging units 26 and the developing units 28 are disposed below the photoconductive drums 25.

The paper feeding unit 12, the conveying path 13, the secondary transfer unit 14, the fixing unit 15, and the paper discharge unit 16 are explained.

As shown in FIG. 2, the paper feeding unit 12 includes a paper feeding cassette 31 and a pickup roller 32.

The paper feeding cassette 31 includes a storing unit 31*a*. The storing unit 31*a* is formed in a bowl shape opened at the top. The storing unit 31*a* is capable of storing a plurality of sheets P on which images are printed. For example, the storing unit 31*a* is capable of storing a large number of (e.g., approximately several hundred) sheets P.

As shown in FIG. 3, the housing 2 includes an opening 2*a*. The paper feeding cassette 31 is inserted into the inside of the opening 2*a* of the housing 2. Consequently, the paper feeding cassette 31 is mounted on the housing 2. In a state in which the paper feeding cassette 31 is mounted on the housing 2, the storing unit 31*a* is located on the inside of the housing 2. The storing unit 31*a* is disposed below the intermediate transfer unit 11. Note that the paper feeding cassette 31 can be drawn out from the housing 2.

As shown in FIG. 2, the pickup roller 32 is provided in the paper feeding cassette 31. The pickup roller 32 sends the sheet P stored in the paper feeding cassette 31 to the conveying path 13.

The conveying path 13 leads from the paper feeding unit 12 to the paper discharge unit 16 through the secondary transfer unit 14 and the fixing unit 15. The sheet P is conveyed on the conveying path 13.

The secondary transfer unit 14 includes a transfer roller 14*a*. The transfer roller 14*a* is in contact with the outer surface of the intermediate transfer belt 21. One belt roller 22*d* supporting the intermediate transfer belt 21 is included in components of the secondary transfer unit 14. The belt roller 22*d* is opposed to the transfer roller 14*a* across the intermediate transfer belt 21. The sheet P is held between the transfer roller 14*a* and the belt roller 22*d* together with the intermediate transfer belt 21. Consequently the recording agents on the intermediate transfer belt 21 are transferred (secondarily transferred) onto the surface of the sheet P. The sheet P passed through the secondary transfer unit 14 is sent toward the fixing unit 15.

The fixing unit 15 includes a heat roller 15*a* and a press roller 15*b*. The heat roller 15*a* is controlled to a fixing temperature (a printing temperature) suitable for fixing of the recording agents. The press roller 15*b* faces the sheet P from the opposite side of the heat roller 15*a*. The sheet P having the recording agents transferred thereon is held between the heat roller 15*a* and the press roller 15*b*. Consequently, the sheet P is heated and pressed between the heat roller 15*a* and the press roller 15*b*. Consequently, the recording agents transferred onto the sheet P are fixed on the sheet P.

The sheet P passed through the fixing unit 15 is discharged to the paper discharge unit 16.

An air blowing structure of the image forming apparatus 1 is explained with reference to FIGS. 3 to 5. Note that, in the figures referred to below, a flow of the air is represented by an arrow F.

The air blowing structure in this embodiment is a structure for blowing the air on the outside of the housing 2 toward the charging units 26 and the developing units 28 of the image forming units 23Y, 23M, 23C, and 23K. The charging units 26 and the developing units 28 are respectively examples of "components (components in the housing)".

More specifically, the image forming apparatus includes a fan 35 and a duct 36.

As shown in FIG. 3, the fan 35 is provided in the housing 2. The fan 35 faces a sidewall 2*b* of the housing 2. The sidewall 2*b* of the housing 2 includes an intake port 37. The intake port 37 is provided in a position corresponding to the fan 35. The intake port 37 opens to the outside of the housing 2. Therefore, if the fan 35 is driven, the air on the outside of the housing 2 flows into the housing 2 through the intake port 37.

The duct 36 guides the air flowing into the housing 2 toward a predetermined region in the housing 2. In this embodiment, the duct 36 guides the air flowing into the housing 2 toward the charging units 26 and the developing units 28. Specifically, the duct 36 includes a branching section 40, a first channel 41, and a second channel 42.

Figure 4:
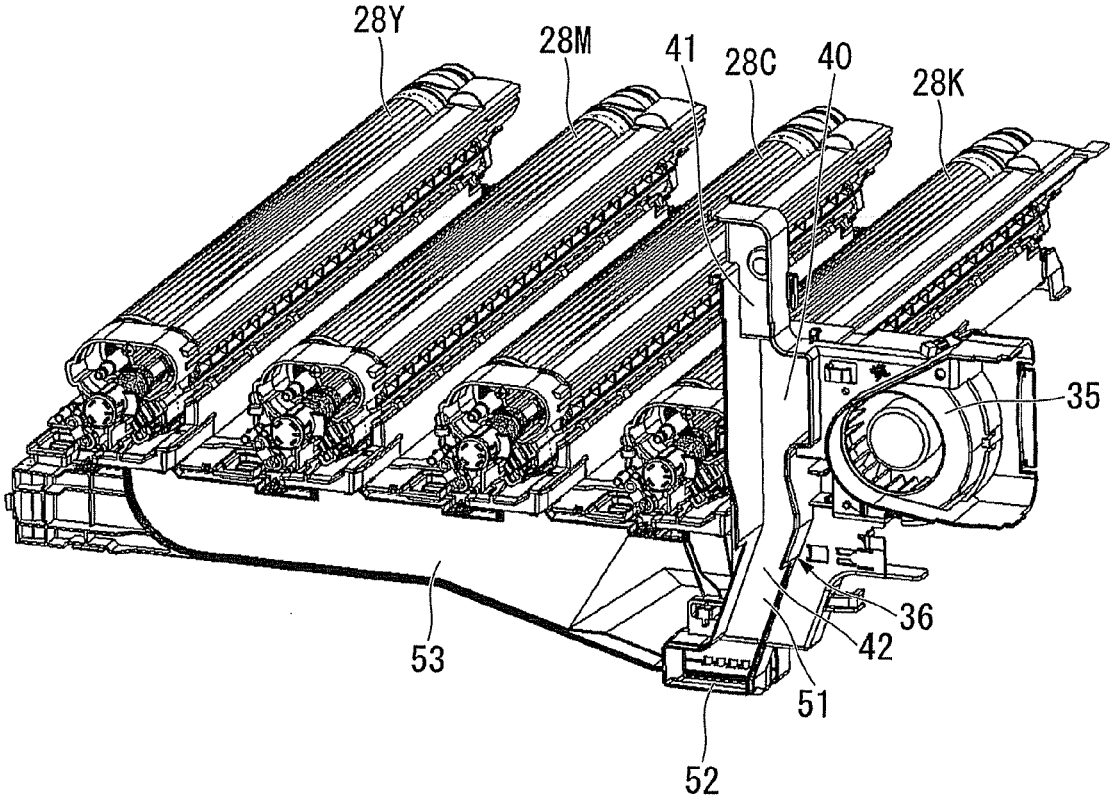
FIG. 4 is a perspective view showing a developing unit, the fan, and the dust in the first embodiment.

As shown in FIGS. 3 and 4, the branching section 40 is located in the vicinity of the fan 35. The air flowing into the housing 2 from the intake port 37 flows into the branching section 40 first. In this embodiment, the branching section 40 is located above the charging units 26 and the developing units 28.

The first channel 41 and the second channel 42 are respectively channels for sending the air to different regions in the housing 2. The first channel 41 and the second channel 42 branch from the branching section 40. The first channel 41 and the second channel 42 extend in opposite directions each other. For example, the first channel 41 extends upward from the branching section 40. The second channel 42 extends downward from the branching section 40. The air in the branching section 40 flows separately into the first channel 41 and the second channel 42.

The second channel 42 is explained in detail below.

The second channel 42 includes a first guide section 51, a bent section 52, and a second guide section 53.

The first guide section 51 connects the branching section 40 and the bent section 52. The first guide section 51 guides the air in the branching section 40 toward the bent section. Specifically, the first guide section 51 extends downward from the branching section 40. For example, the first guide section 51 extends further downward than the charging units 26 and the developing units 28. The first guide section 51 guides the air in the branching section 40 downward.

The bent section 52 is located between the first guide section 51 and the second guide section 53. The bent section 52 connects the first guide section 51 and the second guide section 53.

Figure 6:
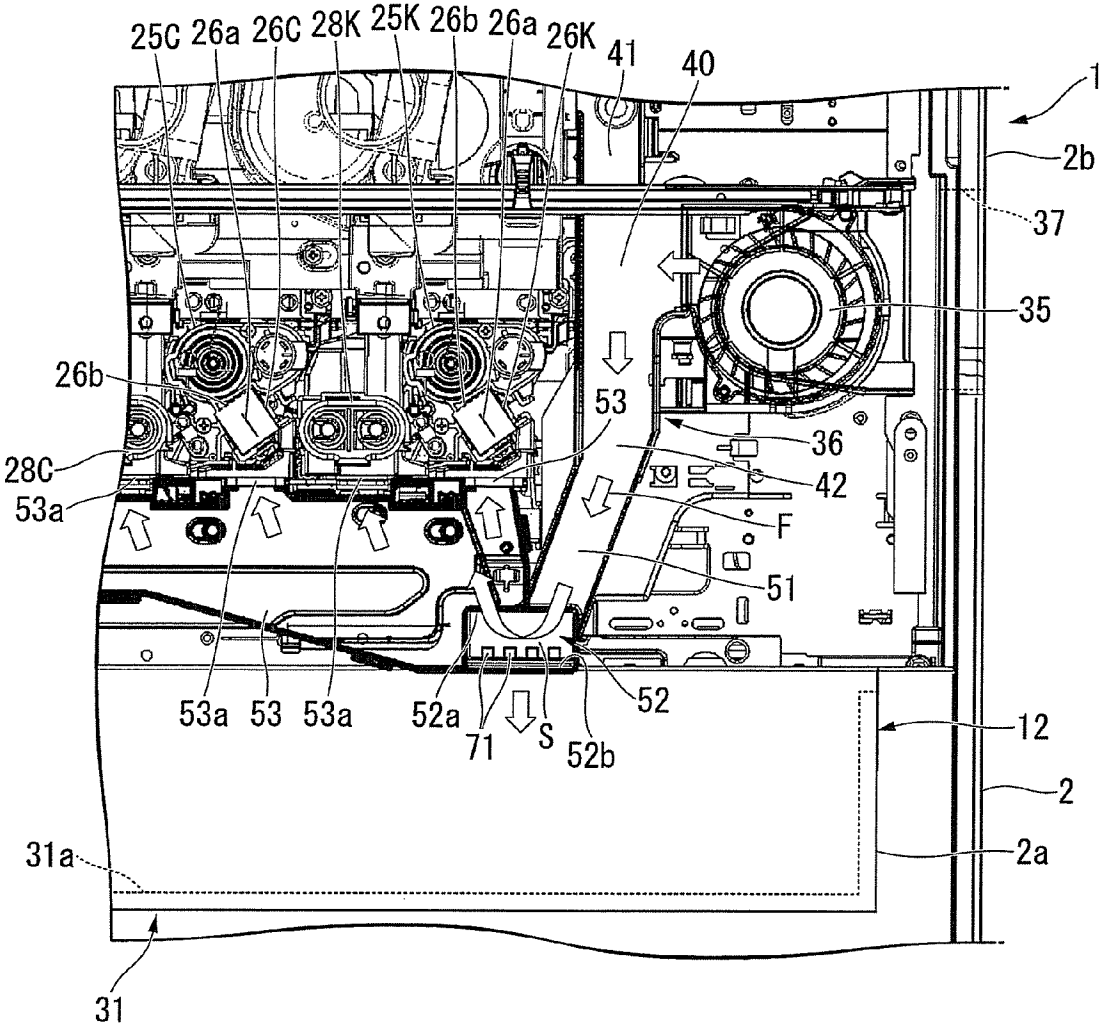
FIG. 6 is a front view showing a bent section in the first embodiment.
Figure 7:
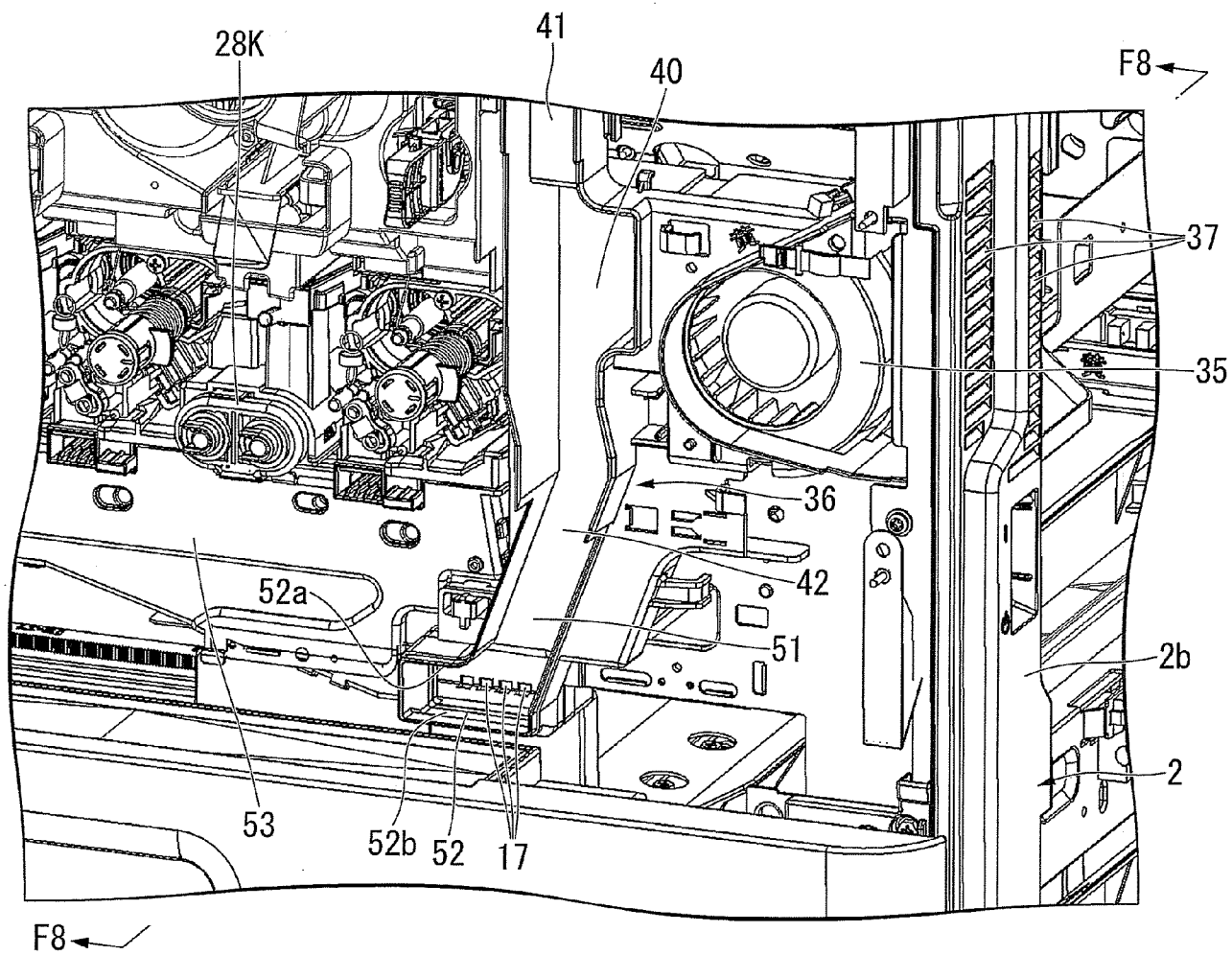
FIG. 7 is a perspective view showing the bent section in the first embodiment.
Figure 8:
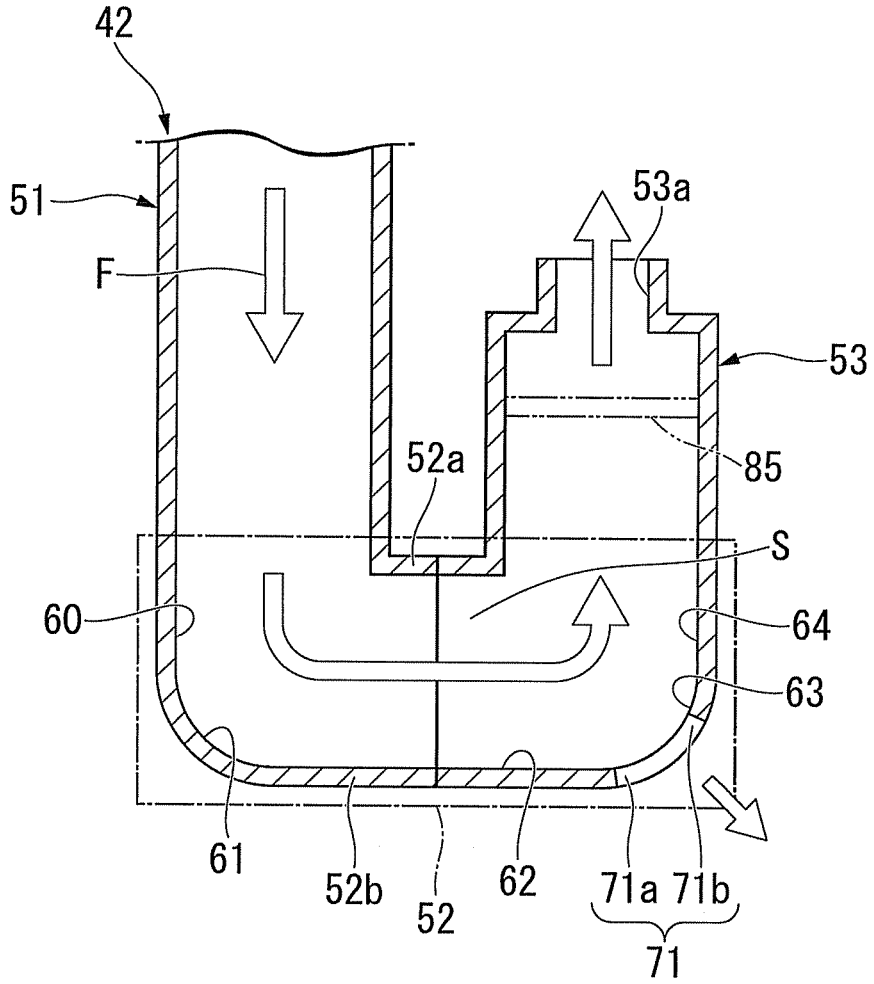
FIG. 8 is a sectional view of the bent section shown in FIG. 7 taken along line F8-F8.

FIGS. 6 to 8 show details of the bent section 52. As shown in FIGS. 6 to 8, the bent section 52 is bent with respect to the first guide section 51. The bent section 52 changes a flowing direction of the air flowing in from the first guide section 51. Note that the bent section 52 may be bent in an arcuate shape with respect to the first guide section 51. Instead, the bent section 52 may be bent in a right-angled shape with respect to the first guide section 51.

For example, the bent section 52 is bent at an angle equal to or larger than 90 degrees. In this embodiment, the bent section 52 is bent at approximately 180 degrees. Note that the bending angle of the bent section 52 is not particularly limited. The bent section 52 only has to be bent even a little with respect to the first guide section 51.

As shown in FIG. 3, in this embodiment, the bent section 52 is located in the bottom of the duct 36. The bent section 52 is located below the charging units 26 and the developing units 28. The bent section 52 changes a flow of the air flowing from the intake port 37 toward a direction different from the direction to the charging units 26 and the developing units to be directed toward the charging units 26 and the developing units 28. In this embodiment, the bent section 52 changes a flow of the air flowing downward to be directed upward.

More specifically, as shown in FIG. 8, the bent section 52 in this embodiment includes a first surface section 52*a* and a second surface section 52*b*. The first surface section 52*a* is a wall surface section located on the inner side in the bending direction of the bent section 52 in the bent section 52. On the other hand, the second surface section 52*b* is a wall surface section located on the outer side in the bending direction of the bent section 52 in the bent section 52.

From another viewpoint, as shown in FIG. 6, the first surface section 52*a* is located on the same side as the charging units 26 and the developing units 28 with respect to an internal space S of the bent section 52. On the other hand, the second surface section 52*b* is located on the opposite side of the charging units 26 and the developing units 28 with respect to the internal space S of the bent section 52. In this embodiment, the first surface section 52*a* is an upper surface section of the bent section 52. The second surface section 52*b* is a lower surface section of the bent section 52.

As shown in FIG. 8, the air flowing into the bent section 52 from the first guide section 51 hits the second surface section 52*b* in the bent section 52. Thereafter, the air hit the second surface section 52*b* flows along the second surface section 52*b*. A flowing direction of the air flowing into the bent section 52 changes along the second surface section 52*b*.

More specifically, the second surface section 52*b* includes a first plane 60, a first corner 61, a second plane 62, a second corner 63, and a third plane 64.

The first plane 60 is located between the first guide section 51 and the first corner 61. The first plane 60 extends substantially in parallel to the first guide section 51. For example, the first plane 60 extends substantially in the vertical direction.

The first corner 61 is located between the first plane 60 and the second plane 62. The first corner 61 is formed in an arcuate shape. The first corner 61 smoothly connects the first plane 60 and the second plane 62. For example, the first corner 61 is bent approximately 90 degrees. The first corner 61 changes a flow of the air flowing downward to be directed substantially to the horizontal direction.

The second plane 62 extends in a direction crossing the first plane 60. For example, the second plane 62 extends in a direction substantially orthogonal to the first plane 60. The second plane 62 extends substantially in the horizontal direction. The second plane 62 is located in the bottom of the bent section 52. The second plane 62 forms the bottom surface of the bent section 52. The air, the flowing direction of which is changed by the first corner 61, flows substantially in the horizontal direction along the second plane 62. The second plane 62 guides the air flowing substantially in the horizontal direction to the second corner 63. Note that the bent section 52 does not have to include the second plane 62. That is, the first corner 61 and the second corner 63 may be directly connected.

Note that the "bottom surface" in this application means one plane. In this embodiment, the second plane 62 forms an example of the "bottom surface". The "bottom surface" in this application also means "a bottom surface in the gravity direction". On the other hand, the "bottom surface section" may include, in addition to one plane, a corner adjacent to the plane. In this embodiment, the first corner 61, the second plane 62, and the second corner 63 are collectively referred to as "bottom surface section". The "bottom surface section" in this application also means "a bottom surface section in the gravity direction".

The second corner 63 is located between the second plane 62 and the third plane 64. The second corner 63 is formed in an arcuate shape. The second corner 63 smoothly connects the second plane 62 and the third plane 64. For example, the second corner 63 is bent approximately 90 degrees. The second corner 63 changes a flow of the air flowing substantially in the horizontal direction to be directed upward.

The third plane 64 is located between the second corner 63 and the second guide section 53. The third plane 64 extends substantially in parallel to the second guide section 53. For example, the third plane 64 extends substantially in the vertical direction.

The second guide section 53 is explained.

As shown in FIGS. 3 and 4, the second guide section 53 is located between the bent section 52 and the charging units 26 and the developing units 28. The second guide section 53 guides the air passed through the bent section 52 toward the charging units 26 and the developing units 28. An internal space of the second guide section 53 extends across the bottoms of the charging units 26 and the developing units 28.

Figure 5:
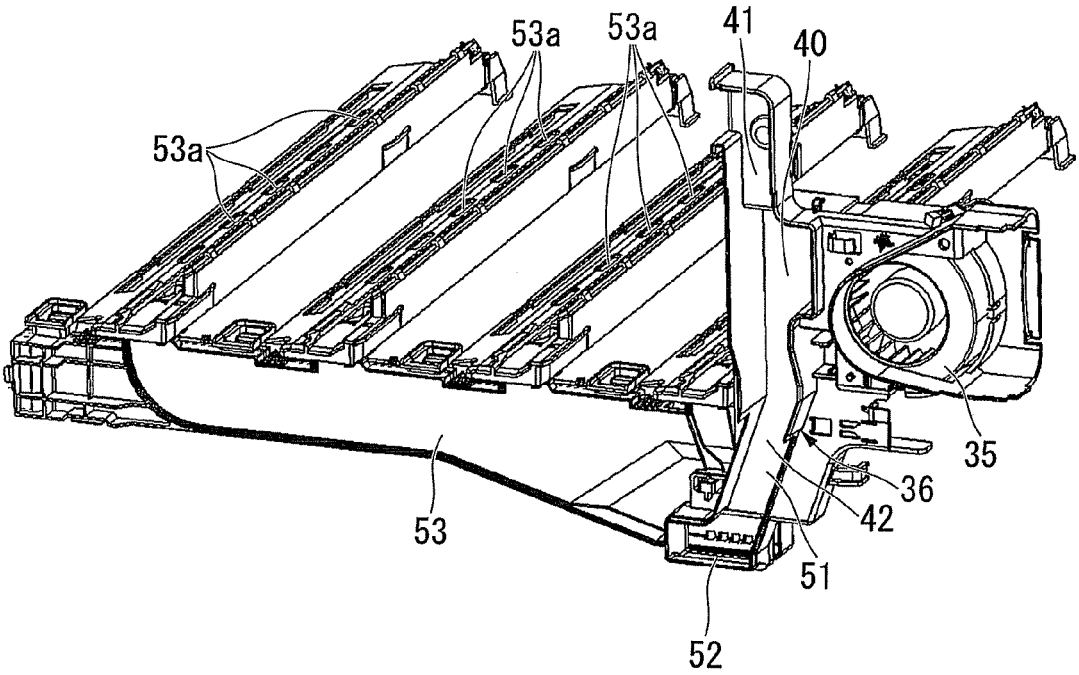
FIG. 5 is a perspective view showing the fan and the duct in the first embodiment.

As shown in FIG. 5, the second guide section 53 includes a plurality of discharge ports 53*a*. The discharge ports 53*a* open toward the respective charging units 26 and the respective developing units 28. The air flowing into the second guide section 53 spreads in the second guide section 53 and is discharged from the discharge ports 53*a* toward the charging units 26 and the developing units 28.

As explained above, the charging units 26 emit ozone when the charging units 26 charge the surfaces of the photoconductive drums 25. Therefore, the ozone tends to be held up around the charging units 26 and the photoconductive drums 25. For example, properties of the surfaces of the photoconductive drums 25 sometimes change if the surfaces are in contact with the ozone for a long time. If the properties of the surfaces of the photoconductive drums 25 change, a failure sometimes occurs in an image printed on the sheet P.

Therefore, in this embodiment, the air is discharged from the duct 36 toward the charging units 26. If the air is discharged from the duct 36 toward the charging units 26, the air around the charging units 26 and the photoconductive drums 25 is ventilated. Consequently, the ozone is eliminated from around the charting units 26 and the photoconductive drums 25. This makes it possible to reduce the likelihood of occurrence of a deficiency in the photoconductive drums 25. The ozone eliminated from around the photoconductive drums 25 is removed by an ozone filter provided in the housing 2.

As explained above, the recording agents stored in the developing units 28 sometimes cause a deficiency when the temperature of the recording agents rises.

Therefore, in this embodiment, the air is discharged from the duct 36 toward the developing units 28. If the air is discharged from the duct 36 toward the developing units 28, the developing units 28 are cooled. Consequently, the recording agents stored in the developing units 28 are cooled. This makes it possible to reduce the likelihood of occurrence of a deficiency in the recording agents.

Holes 71 provided in the duct 36 are explained.

As shown in FIGS. 6 and 7, the bent section 52 in this embodiment includes a plurality of holes 71. The holes 71 are provided in the second surface section 52*b* of the bent section 52. For example, the holes 71 are arranged in a row. For example, the holes 71 are arranged in a direction crossing a flowing direction of the air in the bent section 52. Instead, a part or all of the holes 71 may be arranged along the flowing direction of the air in the bent section 52. Note that the bent section 52 may include only one hole 71.

The holes 71 cause the inside and the outside of the duct 36 to communicate with each other. The holes 71 cause a part of the air flowing in the duct 36 to flow out to the outside of the duct 36 halfway in the duct 36.

In this embodiment, the holes 71 open in a direction different from the direction toward the charging units 26 and the developing units 28. The holes 71 cause a part of the air flowing in the duct 36 to flow out toward a direction different from the direction toward the charging units 26 and the developing units 28.

At least a part of the holes 71 are provided in the bottom surface section of the bent section 52. That is, at least a part of the holes 71 are provided in any one of the first corner 61, the second plane 62, and the second corner 63.

As shown in FIG. 8, in this embodiment, the hole 71 is provided in the second corner 63 of the bent section 52. More specifically, the hole 71 includes a first portion 71*a* and a second portion 71*b*. The first portion 71*a* is located at substantially the same height as the second plane 62 or below the second plane 62. On the other hand, the second portion 71*b* is located above the second plane 62. That is, at least a part of the holes 71 are located above the bottom surface (the second plane 62) of the duct 36.

Note that, instead, at least a part of the holes 71 may be formed in the second plane 62 of the bent section 52. At least a part of the holes 71 may be formed in the third plane 64 of the bent section 52.

From another viewpoint, at least a part of the holes 71 are located on the opposite side of the charging units 26 and the developing units 28 with respect to the internal space S of the bent section 52. In this embodiment, at least the first portion 71*a* is located on the opposite side of the charging units 26 and the developing units 28 with respect to the internal space S of the bent section 52.

In this embodiment, the holes 71 have a polygonal shape. For example, the holes 71 have a square shape. Note that the shape of the holes 71 is not particularly limited. The holes 71 may have another polygonal shape (e.g., a triangular shape or a hexagonal shape) and may have a circular shape.

The number and the size of the holes 71 are not particularly limited. For example, the holes 71 may cause 10 percent or more of the air passing in the duct 36 to flow out. The holes 71 in this embodiment cause approximately 20 percent of the air passing in the duct 36 to flow out. Note that a flow rate of the air flowing out from the holes 71 is not limited to the example explained above.

As shown in FIG. 6, the bent section 52 is located above the storing unit 31*a* of the paper feeding cassette 31. The holes 71 open from the bent section 52 toward the inside of the storing unit 31*a* of the paper feeding cassette 31. The holes 71 cause a part of the air flowing in the duct 36 to flow out toward the inside of the storing unit 31*a* of the paper feeding cassette 31.

Note that, instead, the holes 71 may open toward the outside of the housing 2. That is, the holes 71 may cause a part of the air flowing in the duct 36 to flow out to the outside of the housing 2.

The action of the holes 71 is explained.

The air flowing into the bent section 52 from the first guide section 51 hits the second surface section 52*b* in the bent section 52. The air flows along the second surface section 52*b* of the bent section 52. Consequently, the bent section 52 changes a flowing direction of the air.

Dust included in the air is heavy in terms of mass compared with the air. Therefore, the dust has a large inertial force compared with the air. Therefore, if a bending direction of the air changes, the dust included in the air tends to gather on the outer side in the bending direction compared with the air. That is, the dust included in the air tends to flow along the second surface section 52*b* in the bent section 52.

In this embodiment, the holes 71 are provided in the second surface section 52*b* of the bent section 52. Therefore, at least a part of the dust flowing along the second surface section 52*b* is drawn into the holes 71 in a process of passing the bent section 52. That is, at least a part of the dust flowing along the second surface section 52*b* is discharged to the outside of the duct 36 together with the air flowing out from the holes 71. Consequently, an amount of the dust included in the air after passing the bent section 52 can be reduced. That is, an amount of the dust flowing toward the charging units 26 and the developing units 28 can be reduced.

In this embodiment, the second surface section 52*b* of the bent section 52 is provided in the bottom in the gravity direction of the bent section 52. Therefore, the dust having relatively high density included in the air tends to drop onto the second surface section 52*b* of the bent section 52 with the gravity. Therefore, the dust having the relatively large density tends to gather on the second surface section 52*b*. The dust having the relatively large density is discharged from the holes 71 together with the air flowing out from the holes 71. Therefore, the amount of the dust included in the air after passing the bent section 52 can be further reduced. That is, the amount of the dust flowing toward the charging units 26 and the developing units 28 can be further reduced.

As shown in FIG. 6, the storing unit 31*a* of the paper feeding cassette 31 is disposed below the holes 71. The storing unit 31*a* of the paper feeding cassette 31 is less easily affected by the dust compared with the charging units 26 or the developing units 28. That is, the storing unit 31*a* of the paper feeding cassette 31 less easily causes a problem in the function of the image forming apparatus 1 even if the dust flows into the storing unit 31*a*.

In this embodiment, the dust discharged from the holes 17 is discharged to the inside of the storing unit 31*a* provided below the holes 71. The dust discharged to the storing unit 31*a* is dispersed to adhere to the sheets P stored in the storing unit 31*a* together with other dust present in the air. Consequently, the dust discharged to the storing unit 31*a* is sent to the conveying path 13 in a state in which the dust is dispersed on the sheets P. The conveying path 13 has fixed resistance to the dust. Therefore, the dust discharged to the storing unit 31*a* less easily causes a deficiency of the image forming apparatus 1.

With such a configuration, it is possible to provide the image forming apparatus 1 that less easily causes a deficiency even if the image forming apparatus 1 is used in an environment with a lot of dust.

That is, the image forming apparatus 1 is sometimes used in the environment with a lot of dust. In this case, a lot of dust intrudes into the inside of the image forming apparatus 1 together with the air. For example, if the dust deposits on the charging units 26, it is likely that a charging failure occurs. As a result, it is likely that a failure occurs in an image formed on the print sheet P.

Therefore, the image forming apparatus 1 in this embodiment includes the fan 35 and the duct 36. If the fan 35 is driven, the duct 36 guides the air flowing into the housing 2 from the intake port 37 of the housing 2 toward the charging units 26 and the developing units 28. The duct 36 includes the bent section 52 that changes a flowing direction of the air. The bent section 52 includes the holes 71.

With such a configuration, at least a part of the dust flowing in the duct 36 can be discharged to the outside of the duct 36 halfway in the duct 36. Consequently, an amount of the dust flowing in the duct 36 can be reduced. This makes it possible to reduce the likelihood of adhesion of the dust to the components such as the charging units 26 or the developing units 28.

In this embodiment, the holes 71 open in a direction different from the direction from the bent section 52 toward the charging units 26 and the developing units 28. With such a configuration, the dust discharged from the holes 71 flows in the direction different from the direction toward the charging units 26 and the developing units 28. This makes it possible to reduce the likelihood of adhesion of the dust, which is discharged from the holes 71, to the charging units 26 or the developing units 28.

In this embodiment, the bent section 52 includes the second surface section 52*b* located on the outer side in the bending direction of the bent section 52. At least a part of the holes 71 are provided in the second surface section 52*b* of the bent section 52. With such a configuration, further efficiency of removal of dust can be attained. That is, the dust flowing into the bent section 52 tends to flow along the second surface section 52*b* located on the outer side in the bending direction. Therefore, the dust tends to be caught by the holes 71 in a process of flowing along the second surface section 52*b*. Therefore, the dust can be more efficiently discharged.

In this embodiment, at least a part of the holes 71 are provided in the bottom surface section in the gravity direction of the bent section 52. The dust having relatively high density tends to gather on the bottom surface section of the bent section 52 with the gravity. Therefore, if at least a part of the holes 71 are provided in the bottom surface section of the bent section 52, the dust can be more efficiently discharged.

In this embodiment, the bent section 52 is located in the bottom of the duct 36. The bent section 52 changes a flow of the air flowing downward to be directed upward. In this embodiment, in such a bent section 52, at least a part of the holes 71 are provided in the bottom surface section in the gravity direction of the bent section 52. With such a configuration, the dust having relatively high density has difficulty in flowing upward from the bottom surface section of the bent section 52. Therefore, the amount of the dust flowing in the duct 36 can be further reduced. The dust having difficulty in flowing upward in the bent section 52 is held up on the bottom surface section of the bent section 52. The dust held up on the bottom surface section of the bent section 52 is discharged to the outside of the duct 36 together with the air flowing out from the holes 71. Therefore, if at least apart of the holes 71 are provided in the bottom surface section of the bent section 52, the dust can be more efficiently discharged.

In this embodiment, the bent section 52 includes the first corner 61 and the second corner 63. The first corner 61 changes a flow of the air flowing downward to be directed to substantially the horizontal direction. The second corner 63 changes a flow of the air flowing substantially in the horizontal direction to be directed upward. At least a part of the holes 71 are provided in the second corner 63 of the bent section 52. With such a configuration, a flowing direction of the air is changed a plurality of times by the first corner 61 and the second corner 63. The dust tends to move to the outer side in the bending direction according to the plurality of times of the change in the flowing direction. Therefore, the dust tends to gather near the second corner 63. Therefore, if at least a part of the holes 71 are provided in the second corner 63, the dust can be more efficiently discharged.

Further, in this embodiment, the second corner 63 is a corner for directing the flow of the air flowing substantially in the horizontal direction upward. Therefore, the dust having relatively high density tends to be held up near the second corner 63 with the gravity. Therefore, if at least a part of the holes 71 are provided in the second corner 63, the dust can be more efficiently discharged.

In this embodiment, the second portion 71*b* of the hole 71 is located above the bottom surface (the second plane 62) of the bent section 52. With such a configuration, a part of the dust about to move upward in the second corner 63 tends to be caught by the holes 71. Therefore, with the configuration, the dust can be more efficiently discharged.

In this embodiment, the image forming apparatus 1 further includes the paper feeding cassette 31 disposed below the bent section 52. The holes 71 open from the bent section 52 toward the paper feeding cassette 31. Compared with the charging units 26 or the developing units 28, the paper feeding cassette 31 has less likelihood of occurrence of a deficiency even if dust flows into the paper feeding cassette 31. That is, with the configuration, compared with when the dust adheres to the charging units 26 or the developing units 28, reliability of the image forming apparatus 1 can be improved.

The image forming apparatus 1 in first and second modifications is explained. The modifications are different from the first embodiment in the position of the holes 71. Note that the other components in the modifications are the same as the components in the first embodiment. Therefore, explanation of the components same as the components in the first embodiment is omitted.

First Modification

Figure 9:
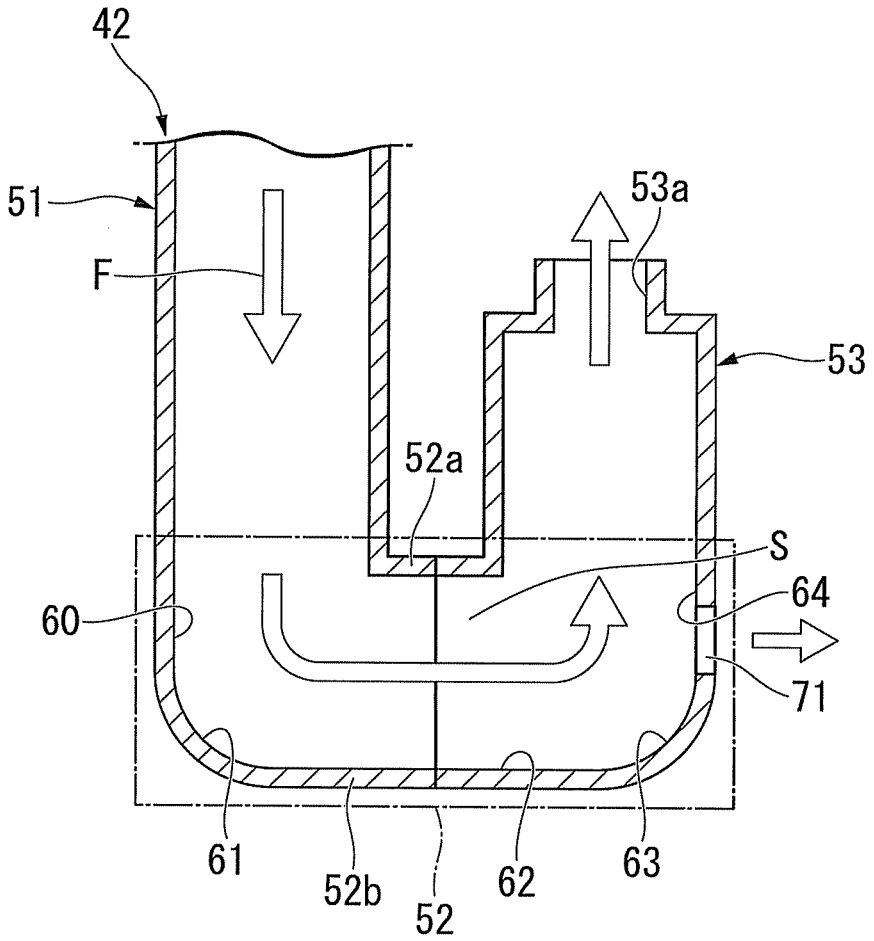
FIG. 9 is a sectional view showing a first modification of the bent section in the first embodiment.

FIG. 9 shows the bent section 52 of the image forming apparatus 1 in the first modification. As shown in FIG. 9, the holes 71 in this modification are located above the bottom surface (the second plane 62) of the bent section 52. The holes 71 are provided, for example, in the third plane 64. With such a configuration, even dust flowing apart from the bottom surface of the bent section 52 tends to be caught by the holes 71.

Second Modification

Figure 10:
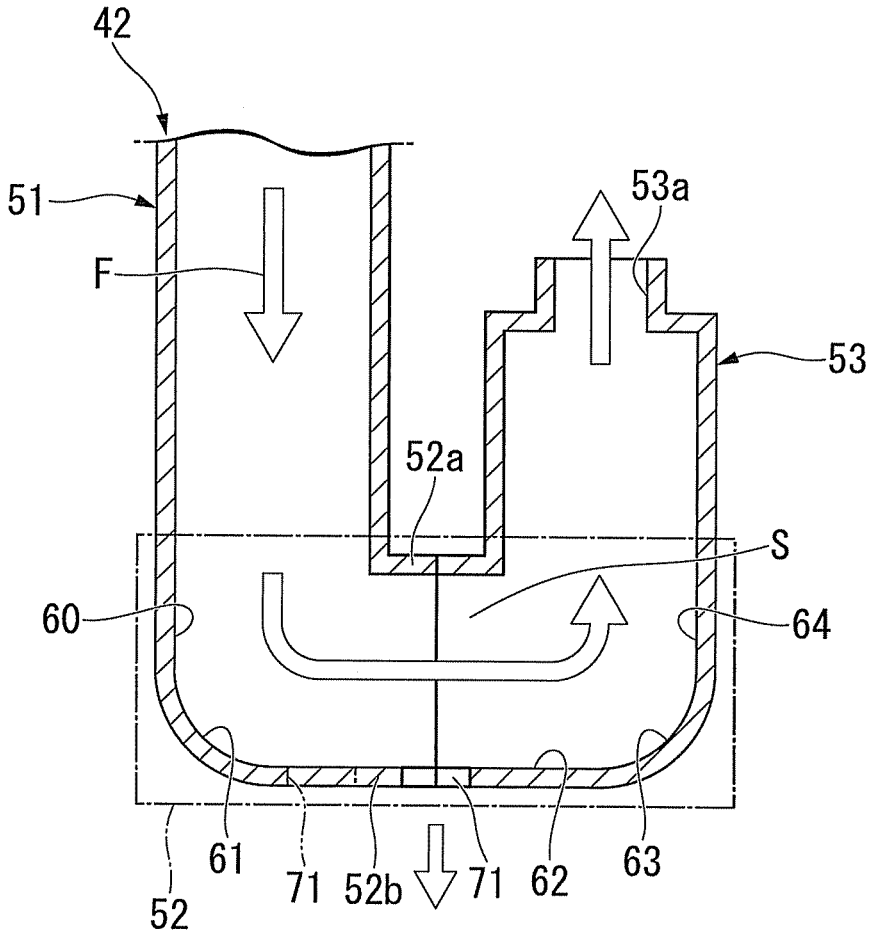
FIG. 10 is a sectional view showing a second modification of the bent section of the first embodiment.

FIG. 10 shows the bent section 52 of the image forming apparatus 1 in the second modification. As shown in FIG. 10, the holes 71 in this modification are provided in the bottom surface (the second plane 62) of the bent section 52. For example, the holes 71 are disposed in a position not overlapping the first guide section 51 in a flowing direction of the air in the first guide section 51.

As explained above, the dust having relatively high density tends to gather on the second surface section 52*b* with the gravity. Therefore, with the configuration of this modification, the dust having relatively high density can be efficiently discharged.

Note that, as indicated by a long and short two dashes line in FIG. 10, the holes 71 may be disposed in a position overlapping the first guide section 51 in the flowing direction of the air in the first guide section 51. However, in this case, a part of the air flowing into the bent section 52 from the first guide section 51 is likely to directly flow out from the holes 71.

Therefore, in this modification, the holes 71 are disposed in the position not overlapping the first guide section 51 in the flowing direction of the air in the first guide section 51. With such a configuration, the dust included in the air can be collected near the second surface section 52*b* by changing the flow of the air in the bent section 52. Consequently, the dust can be efficiently discharged.

Second Embodiment

The image forming apparatus 1 in a second embodiment is explained. This embodiment is different from the first embodiment in that the image forming apparatus 1 includes a filter 81. Note that the other components in this embodiment are the same as the components in the first embodiment. Therefore, explanation of the components same as the components in the first embodiment is omitted.

Figure 11:
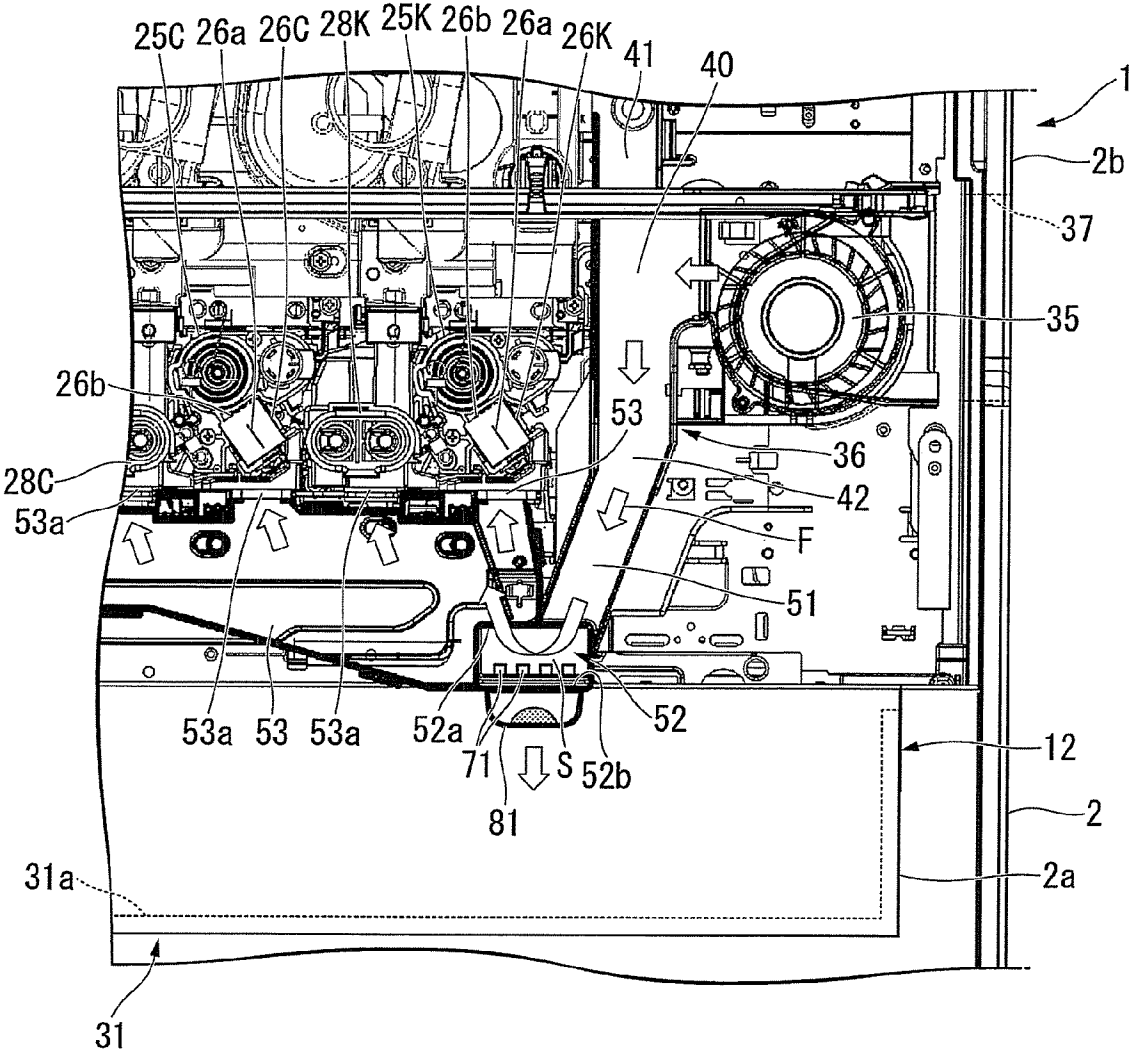
FIG. 11 is a front view showing an image forming apparatus in a second embodiment.

FIG. 11 shows the image forming apparatus 1 in the second embodiment. As shown in FIG. 11, the image forming apparatus 1 includes the filter 81. The filter 81 is provided on the outside of the bent section 52. The filter 81 faces the holes 71. For example, the filter 81 is formed of nonwoven fabric or urethane. Note that the material of the filter 81 is not particularly limited.

The air flowing out from the holes 71 passes through the filter 81. In this process, dust discharged from the holes 71 is collected by the filter 81. The filter 81 is located on the outside of the duct 36. Therefore, even if clogging occurs in the filter 81 because of the dust, a flow of the air in the duct 36 is not deteriorated. That is, even if clogging occurs in the filter 81, a pressure loss less easily occurs in the duct 36. Therefore, the flow of the air in the duct 36 is less easily deteriorated. Therefore, a frequency of replacement of the filter 81 can be reduced. Since a pressure loss less easily occurs in the duct 36, a reduction in the size of the fan 35 can be attained.

The filter 81 is detachably attached to the duct 36. For example, if the paper feeding cassette 31 is drawn out from the housing 2, the filter 81 is exposed to the outside. That is, the filter 81 can be replaced through the opening 2*a* of the housing 2 on which the paper feeding cassette 31 is mounted.

With such a configuration, the dust discharged to the outside of the duct 36 from the holes 71 can be collected by the filter 81. This makes it possible to further reduce the likelihood of adhesion of the dust to the charging units 26 or the developing units 28. This also makes it possible to reduce the likelihood of adhesion of the dust to the other portions of the image forming apparatus 1.

In this embodiment, the filter 81 is detachably attached to the duct 36. With such a configuration, cleaning of the image forming apparatus 1 can be facilitated.

The image forming apparatus 1 in the first and second embodiments is explained above. However, embodiments are not limited to the first and second embodiments. For example, the bent section 52 is not limited to the bent section bent upward. The bent section 52 may be a bent section bent horizontally or may be a bent section bent downward. The fan 35 is not limited to the fan disposed on the upstream side of the duct 36. The fan 35 may be a fan disposed on the downstream side of the components (e.g., the charging units 26 or the developing units 28) in the housing 2.

For example, the duct 36 does not need to be provided across the entire space between the intake port 37 of the housing 2 and the components in the housing 2. The duct 36 may be partially provided in the housing 2. The duct 36 is not limited to the duct integrally provided with the housing 2. A part of the duct 36 may be formed by the surfaces or the like of the components housed in the housing 2.

For example, a general filter 85 for dust collection may be provided in the duct 36 together with the holes 71 (see an alternate long and two short dashes line in FIG. 8). The filter 85 is provided halfway in the intake port 37 or the duct 36. Note that if the filter 85 is disposed on the downstream side of the holes 71 in the flowing direction of the air, the dust adhering to the filter 85 can be reduced. Therefore, a frequency of replacement of the filter 85 can be reduced. If the filter 85 is disposed on the downstream side of the holes 71, clogging less easily occurs in the filter 85. Therefore, the flow of the air is less easily deteriorated in the housing 2. Therefore, a reduction in the size of the fan 35 can be attained.

According to at least one embodiment explained above, an image forming apparatus includes a fan and a duct. The fan is provided in a housing. The duct is provided in the housing. If the fan is driven, the duct guides the air flowing into the housing from an intake port of the housing toward components in the housing. The duct includes a bent section that changes a flowing direction of the air. The bent section includes holes. Consequently, it is possible to provide the image forming apparatus 1 that less easily causes a deficiency even if the image forming apparatus 1 is used in an environment with a lot of dust.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

a fan provided in a housing; and a duct provided in the housing and configured to guide, if the fan is driven, air flowing into the housing from an intake port of the housing toward components in the housing, wherein the duct includes a bent section that changes a flowing direction of the air, the bent section includes: holes, a bottom surface in a gravity direction of the bent section, a first plane extending substantially in a vertical direction, and a first corner located between the first plane and the bottom surface, the first corner changes a flow of the air flowing downward to be directed substantially to a horizontal direction, the bottom surface extends in a direction crossing the first plane, and at least a part of the holes are provided in the bottom surface section of the bent section.

2. The apparatus according to claim 1, wherein the holes open from the bent section toward an inside of a storing unit of a paper feeding cassette.

3. The apparatus according to claim 1, wherein the holes open in a direction different from a direction toward the component.

4. The apparatus according to claim 1, wherein the bent section includes a wall surface section located on an outer side in a bending direction of the bent section, and at least a part of the holes are provided in the wall surface section of the bent section.

5. The apparatus according to claim 1, wherein the bent section is located in a bottom of the duct and changes a flow of the air flowing downward to be directed upward.

6. The apparatus according to claim 1, wherein the bent section further includes a second corner that changes a flow of the air flowing in the substantially horizontal direction to be directed upward, and at least a part of the holes are provided in the second corner of the bent section.

7. The apparatus according to claim 1, further comprising a paper feeding section disposed below the bent section and capable of storing sheets, wherein the holes open from the bent section toward the paper feeding section.

8. The apparatus according to claim 1, further comprising a filter provided on an outside of the bent section and facing the holes.

9. The apparatus according to claim 8, wherein the filter is detachably attached to the duct.

* * * * *